US009339830B2

(12) United States Patent
De Roo

(10) Patent No.: US 9,339,830 B2
(45) Date of Patent: May 17, 2016

(54) LID WITH VENTILATION SYSTEM

(71) Applicant: EMM Holding BV, Zwolle (NL)

(72) Inventor: Peter Robert De Roo, Zoetermeer (NL)

(73) Assignee: EMM HOLDING BV, Zwolle (NL)

( * ) Notice: Subject to any disclaimer, the term of this patent is extended or adjusted under 35 U.S.C. 154(b) by 22 days.

(21) Appl. No.: 14/483,305

(22) Filed: Sep. 11, 2014

(65) Prior Publication Data

US 2016/0059254 A1 Mar. 3, 2016

(30) Foreign Application Priority Data

Aug. 27, 2014 (EP) ..... 14182417

(51) Int. Cl.

| | |
|---|---|
| ***B65D 51/16*** | (2006.01) |
| ***B05B 11/00*** | (2006.01) |
| ***B05B 7/24*** | (2006.01) |

(52) U.S. Cl.

CPC ..... *B05B 11/0016* (2013.01); *B05B 7/2478* (2013.01); *B05B 11/0037* (2013.01); *B65D 51/1644* (2013.01)

(58) Field of Classification Search

CPC ..... B05B 11/0016; B05B 11/0037; B65D 51/1644

USPC ..... 220/373, 367.1, 87.1, 87.2, 203.27, 220/203.29, 303, 915; 222/181.1, 188, 478

See application file for complete search history.

(56) References Cited

U.S. PATENT DOCUMENTS

| | | | | |
|---|---|---|---|---|
| 2012/0234870 | A1* | 9/2012 | Good | B05B 11/0016 222/382 |
| 2013/0292493 | A1* | 11/2013 | Marsalek | B05B 11/0016 239/379 |
| 2014/0203047 | A1* | 7/2014 | McNulty | B05B 7/0025 222/190 |

FOREIGN PATENT DOCUMENTS

| | | |
|---|---|---|
| DE | 102007048440 B3 | 4/2009 |
| WO | 2005077543 | 8/2005 |
| WO | 2005077543 A1 | 8/2005 |
| WO | 2009046806 | 4/2009 |

OTHER PUBLICATIONS

European Search Report No. 14182417.7-1760, reported on Mar. 2, 2015.

* cited by examiner

*Primary Examiner* — Robert J Hicks
*Assistant Examiner* — Kareen Thomas
(74) *Attorney, Agent, or Firm* — Miller, Matthias & Hull LLP

(57) ABSTRACT

A lid (2) for a reservoir (1) to be connected to a liquid spraying device, comprising a ventilation hole (3); a flexible tube (4); and a valve (5), wherein the combination of the ventilation hole (3), the flexible tube (4), and the valve (5) forms a ventilation system which allows an air movement from the outside of the reservoir (1) via the ventilation system to the inside of the reservoir (1) while it blocks the movement of a liquid (6) from the inside of the reservoir (1) via the ventilation system to the outside of the reservoir (1).

13 Claims, 3 Drawing Sheets closed opened

LID WITH VENTILATION SYSTEM

BACKGROUND

1. Technical Field

The present disclosure generally relates to a lid for a reservoir to be connected to a liquid spraying device, in particular a lid with a ventilation system for venting the reservoir.

2. Description of the Related Art

Today, different kinds of liquid spraying devices are known. These kinds of liquid spraying devices use different techniques to transport liquid from a reservoir to a spraying mechanism. In general, suction feed liquid spraying devices and gravity feed liquid spraying devices are known. In the case of the suction feed liquid spraying devices, the reservoir is generally located below the spraying mechanism and the liquid is sucked from the reservoir by negative pressure. In the case of the gravity feed liquid spraying devices, the reservoir is generally located above the spraying mechanism and the liquid can flow from the reservoir towards the spraying mechanism according to the principle of gravity.

Independent from these different techniques, it is desirable to have an undisturbed flow of the liquid from the reservoir to the spraying mechanism in order to achieve a uniform application of the liquid onto a surface which has to be treated.

WO 2005/077543 A1 describes a reservoir for a gravity feed liquid spraying device with a vent opening at the bottom of the reservoir, wherein the vent opening is closed when the reservoir is filled with liquid and is opened after the complete spraying device is turned upside down so that the reservoir is positioned above the spraying mechanism for spraying. However, opening and closing the vent opening at the correct point in time is cumbersome and may cause problems, such as liquid leaving the reservoir, if the vent opening is not closed correctly.

WO 2009/046806 A1 describes a lid for a reservoir of a gravity feed liquid spraying device. The lid is provided with a vent opening constructed as a labyrinth seal formed by three cylinders being plugged into each other. The labyrinth seal is intended to prevent liquid from flowing out of the reservoir both when the reservoir is in its upright position and when the reservoir is inverted during the liquid spraying process. However, the labyrinth seal cannot always prevent liquid from flowing past the labyrinth seal. This is in particular the case when the reservoir is inverted. Moreover, the labyrinth seal protrudes from the lid, such that the lid cannot be stored in a space-saving manner.

SUMMARY OF THE DISCLOSURE

The embodiments disclosed herein provide a reservoir with a vent opening for venting the reservoir which reliably prevents liquid from flowing out of the reservoir during use. In addition, these embodiments provide individual components of the reservoir that are storable in a space-saving manner as well as easily and securely transportable.

The lid for a reservoir to be connected to a liquid spraying device according to the disclosure comprises a ventilation hole, a flexible tube, and a valve, wherein the combination of the ventilation hole, the flexible tube, and the valve forms a ventilation system which allows an air movement from the outside of the reservoir via the ventilation system to the inside of the reservoir while it blocks the movement of a liquid from the inside of the reservoir via the ventilation system to the outside of the reservoir.

This new ventilation system provides a reliable venting of the reservoir, i.e. without risk of liquid flowing into the venting system. This is the case, since the ventilation hole does not require opening or closing during use of the liquid spraying device. The flexible tube serves as an extension of the ventilation hole into the inside of the reservoir and is sealed at its distal end by the valve in a liquid tight manner. The valve prevents liquid from flowing out of the reservoir into the ventilation system during use, i.e. during the refilling process, as the spraying device is inverted from the filling position to the spraying position, and during the spraying process. In addition, it is possible to easily refill the reservoir by removing the lid from the reservoir together with the ventilation system.

Due to the new ventilation system, the lid according to the present disclosure could be easily stored and transported. This is the case, since the tube is flexible. While the prior art lid has a protruding labyrinth seal formed by three rigid cylinders, the flexible tube according to the present disclosure enables the tube, and therefore the ventilation system, to be placed in a position in which it does not disturb during storing and transporting. In accordance with the present disclosure, a flexible tube is a tube which could be bent at at least one point of the length of the tube. However, in a preferred embodiment, the flexible tube could be bent at several points, i.e. at at least two points. In a further preferred embodiment, the flexible tube could be bent at any point of the length, which is identified herein as a "completely flexible" tube.

Basically, the liquid used for the spraying process may be any flowable material, but preferably one of color, paint, glue, or garden chemicals.

In a preferred embodiment, the flexible tube is made at least in part of a flexible material having at the same time a sufficient stiffness in order to prevent collapse due to liquid pressure. Preferably, the flexible tube is made at least in part of rubber, silicone, or plastic, wherein plastic is preferably polyethylene or polyprophylene.

In a further preferred embodiment, the flexible tube is adapted for allowing the valve to be located above a liquid level in the reservoir during operation by means of a gravity feed liquid spraying device. This may be achieved, for example, by using a tube having a suitable length. In general, the reservoir may be formed by a lid and a container. For filling the reservoir, the container is placed on its bottom and the liquid to be sprayed is filled in the container through an opening at the opposite side of the container, i.e. opposite to the bottom. In subsequent steps, the opening is closed by the lid to form the reservoir and the reservoir is connected to the spraying device. When the reservoir and the spraying device are turned, some liquid flows into the lid and in the spraying device. As a consequence, in this upside down position, the reservoir is not completely filled with the liquid. Therefore, a tube with a suitable length will cause that at least the valve connected to the tubes is located above the liquid level when the reservoir is upside down and the spraying device is in operation. Preferably, the tube has also a sufficient stiffness to locate the valve above the liquid level.

In general, the lid with the ventilation system may consist of one, two, three or more pieces. The lid, the flexible tube, and the valve can be formed in one piece. This does not necessarily mean that the ventilation system is produced in one piece. The components of the ventilation system such as the flexible tube and the valve may be produced separately but permanently put together, e.g. glued to form one piece. However, it is also possible that at least some of the components are removable connected to each other and therefore form several pieces.

In a further preferred embodiment, at least portions of the ventilation system have a buoyancy that is high enough to enable the valve to float on the liquid. For example, the shape and/or the material of the valve may be chosen so that the valve floats on the liquid. This may be supported by the shape and/or the material of the flexible tube.

In a further preferred embodiment, portions of the lid form a cavity, wherein the flexible tube and the valve are adapted for being arranged at least in part in the cavity. In particular, the flexible tube and the valve could be stored at least in part in the cavity during transport of the lid. This substantially reduces the space needed by the lid as compared to some lids known in the prior art. Additionally, the lid can be easily sealed with a material that can be removed before using the lid, such that the lid is protected from dust and dirt during transport and storing. However, when the lid is connected to a container of a reservoir, the flexible tube and the valve could be taken out of the cavity so that the valve is located above the liquid level in the reservoir during operation by means of a gravity liquid spraying device. As described above, the flexible tube could be realized in different ways. For example, the flexible tube could be a completely flexible tube which is flexible enough to be arranged circular or serpentine in the cavity. Since the valve is preferably small and compact, it either marginally protrudes beyond the dimensions of the lid itself or does not protrude beyond the dimensions of the lid itself at all when arranged in the cavity. Preferably, the cavity is a groove nearby the edge of the lid.

In a further preferred embodiment, the flexible tube comprises nearby the ventilation hole a hinge that allows an orientation of the flexible tube in various directions. Preferably, the hinge is a section of the flexible tube comparable with the bellows-shaped section of a straw. Nevertheless, other implementations of the hinge are conceivable so long as an air movement through the hinge as well as an airtight sealing of the hinge against the inside of the reservoir are ensured.

In a further preferred embodiment, the lid further comprises means for detachably connecting the flexible tube and/or the valve to the lid at a location apart from the ventilation hole. This means for detachably connecting enables that the flexible tube and the valve stay at least partially in the cavity during transport of the lid.

In a further preferred embodiment, the means for detachably connecting the flexible tube and/or the valve to the lid comprises at least one clamp. Preferably, the at least one clamp is a horseshoe-shaped tube clamp comprising a central, preferably circular, opening for the flexible tube and two slightly movable wing portions forming an inlet opening to the central opening. Thereby, the width of the inlet opening is smaller than the smallest diameter of the central opening, such that the wing portions have to be moved away from each other in order to insert the flexible tube into the central opening. Such a horseshoe-shaped tube clamp is advantageous since the connection of the flexible tube with the lid can be easily detached by simply pulling out the flexible tube of the horseshoe-shaped tube clamp. However, the person skilled in the art knows several alternatives, how the flexible tube could be connected to the lid.

In a further preferred embodiment, the valve comprises a valve body forming a first opening and a second opening, wherein the first opening is adapted to be connected to the flexible tube in such a way that the flexible tube generally extends in a layer parallel to the second opening. Thereby, air can enter the inside of the reservoir via the second opening of the valve body. The flexible tube extending in a layer parallel to the second opening is advantageous since herewith the flexible tube and the valve can be arranged in a cavity formed by portions of the lid in an even more space-saving manner. In particular, it can be avoided that the valve protrudes beyond the dimensions of the lid itself.

In a further preferred embodiment, the valve body further comprises a valve seat having a sealable valve opening. The sealable valve opening blocks movement of liquid from the second opening to the first opening, while permitting movement of air from the first opening to the second opening. Preferably, the sealable valve opening is arranged in a layer which is parallel to the second opening, but which is substantially perpendicular to the layer of the first opening. This is advantageous since herewith the flexible tube does not have to be connected directly to the sealable valve opening in order to allow an air movement from the outside of the reservoir to the inside of the reservoir. Instead, the flexible tube can be connected to the valve at the most technically appropriate position with regards to storing the lid as space-saving as possible, namely at the first opening.

In a further preferred embodiment, the valve comprises venting means arranged at the side of the sealable valve opening facing the second opening, wherein the venting means prevents liquid from the inside of the reservoir from entering the flexible tube and allows air movement from the outside of the reservoir into the reservoir.

Suitable venting means may be formed by an air-permeable but liquid-tight body. Such a body which is air-permeable and liquid-tight may prevent liquid drops from entering the flexible tube and at the same time may allow an air pressure compensation between the outside of the reservoir and the inside of the reservoir. An example for a suitable air-permeable but liquid-tight body is a fine grid that is air-permeable all the time. However, it is also possible to use an air-permeable but liquid-tight body that becomes only air-permeable when the air pressure in the inside of the reservoir decreases.

In a preferred embodiment, the venting means comprises an elastically deformable membrane. On the one hand, this elastically deformable membrane can be arranged in a closed position, where it lies on the valve seat and seals the sealable valve opening by covering the sealable valve opening. In such an arrangement, it is advantageously prevented that liquid drops get into the flexible tube as well as that air moves from the outside of the reservoir via the ventilation system to the inside of the reservoir when there is no need for an air pressure compensation between the inside of the reservoir and the outside of the reservoir. When the air pressure inside of the reservoir decreases, at least a portion of the elastically deformable membrane curves away from the valve seat. Hence, on the other hand, the elastically deformable membrane can be arranged in an open position, where it is at least partially lifted from the valve seat and thus forms a certain air passage. Such an arrangement is advantageous since air can flow from the outside of the reservoir via the ventilation hole, the flexible tube, the first opening of the valve body, the sealable valve opening, the air passage, and finally the second opening of the valve body to the inside of the reservoir and thus an air pressure compensation between the outside of the reservoir and the inside of the reservoir can take place. Upon completion of such an air pressure compensation, the elastically deformable membrane moves back to its closed position. The elastically deformable membrane may be made at least in part of any elastic material, but preferably it is made at least in part of rubber, silicone, or plastic, wherein plastic is preferably polyethylene or polyprophylene. Advantageously, when the deformable membrane is in the open position, liquid drops may be prevented from entering the flexible tube. This is, since the air passage is only present if air flows from the outside of the reservoir to the inside of the reservoir in order to compensate air pressure and as long as air flows, liquid cannot flow in the opposite direction into the valve.

In a further preferred embodiment, the venting means further comprise a seal liquid for enhancing the sealing, wherein the seal liquid is located in at least one area between the valve seat and the elastically deformable membrane. Preferably, the seal liquid is a silicone oil which is located in concentric channels surrounding the sealable valve opening. Such a seal liquid is advantageous since it enables an even better liquid tightness as well as air tightness when the elastically deformable membrane is arranged in the closed position.

By the lid for a reservoir described above, for the first time a lid for a reservoir with a vent opening which reliably prevents that liquid could flow out of the reservoir during use is provided. In addition, the lid is designed in such a way that it is storable in a space-saving manner as well as easily and securely transportable.

BRIEF DESCRIPTION OF THE DRAWINGS

In the following, the disclosure is further described by reference to the schematic illustrations shown in the figures, wherein.

It should be understood that the drawings are not necessarily to scale and that the disclosed embodiments are sometimes illustrated diagrammatically and in partial views. In certain instances, details which are not necessary for an understanding of the disclosed methods and apparatus or which render other details difficult to perceive may have been omitted. It should be understood, of course, that this disclosure is not limited to the particular embodiments illustrated herein.

DETAILED DESCRIPTION

Figure 1:
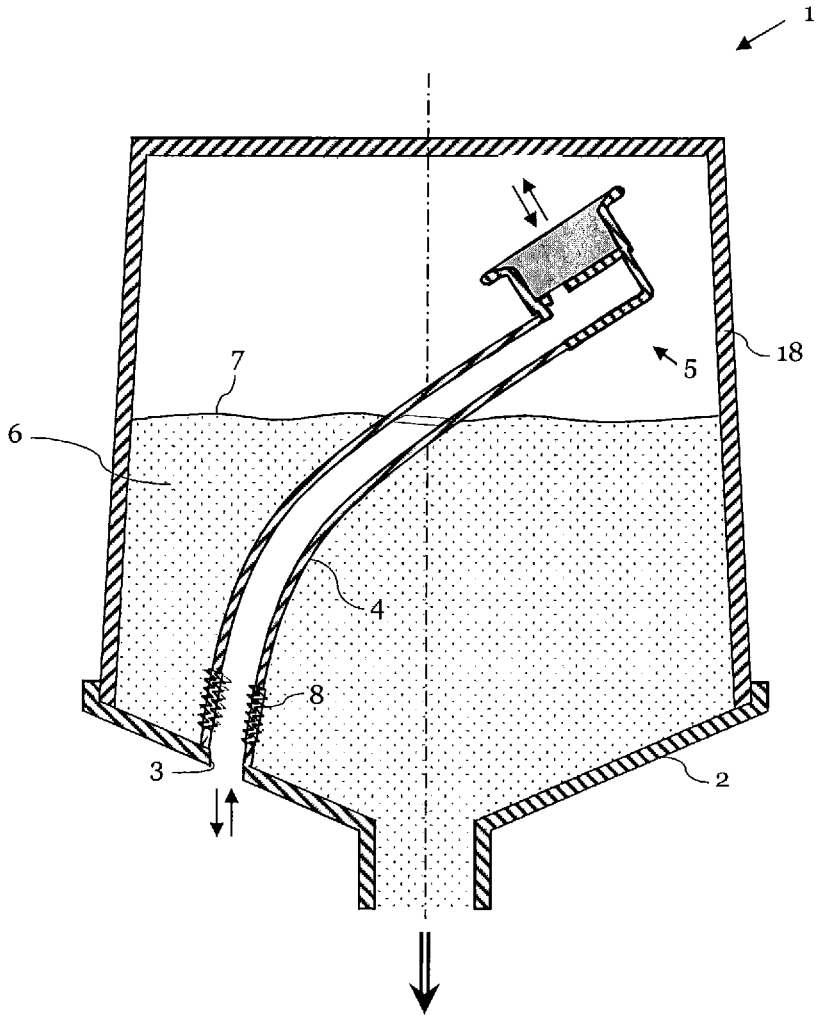
FIG. 1 shows a cross section of an embodiment of a lid for a reservoir according to the disclosure.

FIG. 1 shows a cross section of an embodiment of a lid 2 according to the present disclosure connected to a container 18 to form a reservoir 1, with the lid 2 in an inverted position to facilitate use with a gravity feed spraying device. The lid 2 comprises a ventilation hole 3, a flexible tube 4, and a valve 5. In the following, the combination of the ventilation hole 3, the flexible tube 4, and the valve 5 is referred to as the ventilation system. As shown in FIG. 1, the ventilation system, in particular the flexible tube 4, is adapted to allow the valve 5 to be located above a level 7 of a liquid 6 in the reservoir 1 during operation by means of a gravity feed liquid spraying device. Among others, this could be achieved due to a sufficient length and a sufficient stiffness of the flexible tube 4.

Figure 2:
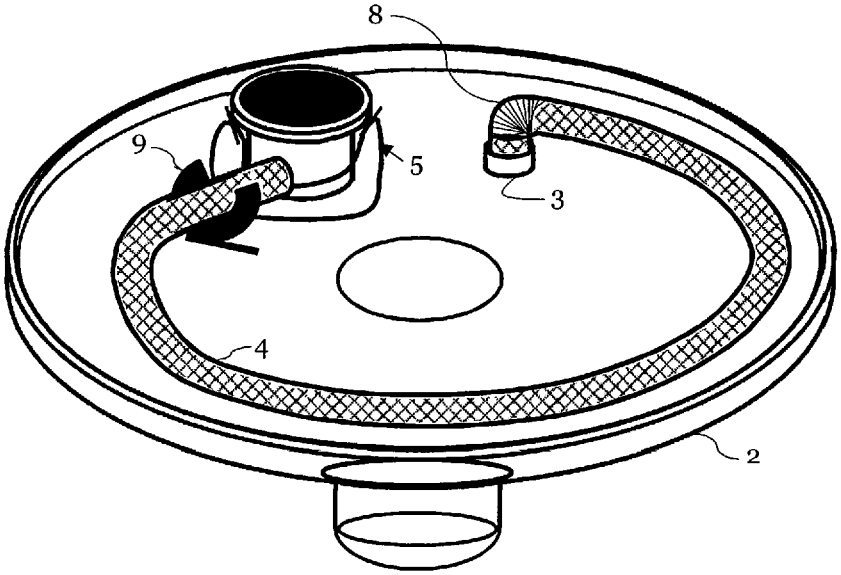
FIG. 2 shows a side view of a ventilation system arranged in a cavity formed by portions of an embodiment of a lid for a reservoir according to the disclosure.

FIG. 2 shows a side view of a lid 2 according to the disclosure as it may be transported. The flexible tube 4 and the valve 5 are arranged in a cavity formed by portions of the lid 2. In the embodiment shown in FIG. 2, the flexible tube 4 and the valve 5 are completely arranged in the cavity. Nevertheless, according to this disclosure it is sufficient if portions of the flexible tube 4 and the valve 5 are arranged in the cavity. For arranging the flexible tube 4 and the valve 5 in the cavity, in the present embodiment the flexible tube 4 comprises nearby the ventilation hole 3 a bellows-shaped section 8 which allows the flexible tube 4 to be bent so that it may be arranged easily in the cavity of the lid 2. However, the bend of the flexible tube 4 can also be achieved by any kind of hinge or by simply utilizing the elasticity of the flexible tube itself. Furthermore, for arranging the ventilation system in the cavity, in the present embodiment the flexible tube 4 is bent in a circular shape. In order to prevent the flexible tube 4 from returning from its circular bent position to its original position due to forces resulting from its elasticity, the lid 2 further comprises a horseshoe-shaped tube clamp 9 in whose central opening the flexible tube 4 is inserted. Nevertheless, any kind of clamp and any kind of easily removable adhesive tapes or adhesive points may be used for detachably connecting the flexible tube 4 and/or the valve 5 to the lid 2.

Figure 3:
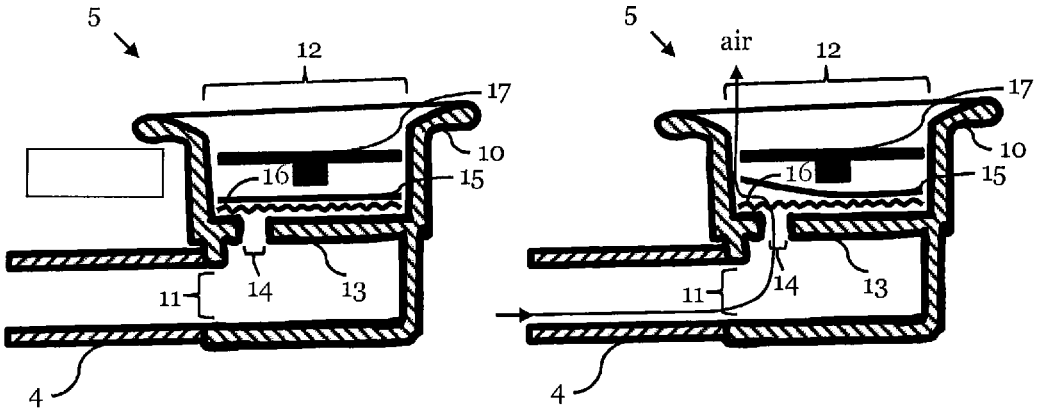
FIG. 3 shows a cross section of an embodiment of a valve for a lid according to the disclosure.

FIG. 3 shows a cross section of a valve 5 of an exemplary embodiment ventilation system according to the disclosure. In the illustrated embodiment, the valve 5 comprises a valve body 10 forming a first opening 11 and a second opening 12. The flexible tube 4 is connected to the first opening 11 and generally extends in a layer parallel to the second opening 12. The valve body 10 also comprises a valve seat 13 having a sealable valve opening 14. Venting means are arranged at the side of the sealable valve opening 14 facing the second opening 12 in order to prevent liquid 6 from inside the reservoir 1 from entering the flexible tube 4, and to permit air from outside the reservoir 1 to communicate with an interior of the reservoir 1. For this purpose, the venting means in this embodiment comprises an elastically deformable membrane 15 as well as a sealing liquid 16 located between the valve seat 13 and the elastically deformable membrane 15.

FIG. 3 illustrates the sealable valve opening 14 in both a closed state as well as in an open state. In the case of the sealable valve opening 14 being in its closed state as shown on the left-hand side of FIG. 3, the elastically deformable membrane 15 is arranged in a closed position. In this closed position, the elastically deformable membrane 15 completely covers the sealable valve opening 14 by lying on the valve seat 13. Sealing between the membrane 15 and the valve seat 13 is further improved by the sealing liquid 16. Due to this combination, an outstanding liquid tightness as well as air tightness is ensured in the closed position. In the illustrated embodiment, the sealable valve opening 14 changes from closed to open state when the air pressure in the inside of the reservoir 1 decreases during the spraying process, as shown on the right-hand side of FIG. 3. During the change from the closed state to the open state, a portion of the elastically deformable membrane 15 curves away from the valve seat 13 in the direction of the second opening 12 of the valve body 10. At the same time, other portions of the elastically deformable membrane 15 are forced not to curve away from the valve seat 13 and instead to remain laying on the valve seat 13, such as by means of a stop element 17. Such a stop element 17 prevents the elastically deformable membrane 15 from too extensively lifting from the valve seat 13 and thus prevents an air passage formed thereby getting too large. Hence, in the case of the sealable valve opening 14 being in its open state, the elastically deformable membrane 15 is arranged in an open position forming an air passage for allowing air pressure compensation. Thereby, air flows from the outside of the reservoir 1 via the flexible tube 4 and the valve 5 to the inside of the reservoir 1 and at the same time the elastically deformable membrane 15 steadily moves back to its closed position up to the completion of the air pressure compensation.

All references, including publications, patent applications, and patents, cited herein are hereby incorporated by reference. The description of certain embodiments as "preferred" embodiments, and other recitation of embodiments, features, or ranges as being preferred, is not deemed to be limiting, and the claims are deemed to encompass embodiments that may presently be considered to be less preferred. All methods described herein can be performed in any suitable order unless otherwise indicated herein or otherwise clearly contradicted by context. The use of any and all examples, or exemplary language (e.g., "such as") provided herein, is intended to illuminate the disclosed subject matter and does not pose a limitation on the scope of the claims. Any statement herein as to the nature or benefits of the exemplary embodiments is not intended to be limiting, and the appended claims should not be deemed to be limited by such statements. More generally, no language in the specification should be construed as indicating any non-claimed element as being essential to the practice of the claimed subject matter. The scope of the claims includes all modifications and equivalents of the subject matter recited therein as permitted by applicable law. Moreover, any combination of the above-described elements in all possible variations thereof is encompassed by the claims unless otherwise indicated herein or otherwise clearly contradicted by context. The description herein of any reference or patent, even if identified as "prior," is not intended to constitute a concession that such reference or patent is available as prior art against the present disclosure.

What is claimed is:

1. A lid for a reservoir to be connected to a liquid spraying device, comprising:

a lid portion defining a cavity;

a ventilation hole;

a flexible tube; and a valve, wherein a combination of the ventilation hole, the flexible tube, and the valve forms a ventilation system which allows an air movement in a first direction, from the ventilation hole and through the flexible tube and valve, while blocking movement of a liquid in a second direction opposite the first direction, from the valve and through the flexible tube and ventilation hole; and wherein the tube is sufficiently flexible to deflect from an original position to a bent position, in which the tube and valve are at least partially received within the cavity.

2. The lid of claim 1, wherein the flexible tube is made at least in part of rubber, silicone, or plastic.

3. The lid of claim 1, wherein, in the original position, the flexible tube is configured to maintain the valve above a liquid level in the reservoir during operation by means of a gravity feed liquid spraying device.

4. The lid of claim 1, wherein the flexible tube includes a hinge positioned nearby the ventilation hole, and wherein the hinge is configured to permit an orientation of the flexible tube in multiple directions relative to the ventilation hole.

5. The lid of claim 1, further comprising means for detachably connecting the flexible tube and/or the valve to the lid at a location spaced from the ventilation hole.

6. The lid of claim 5, wherein the means for detachably connecting the flexible tube and/or the valve to the lid comprises at least one clamp.

7. The lid of claim 1, wherein the valve comprises a valve body defining a first opening and a second opening, wherein the first opening is adapted to be connected to the flexible tube such that the flexible tube is substantially aligned with the second opening.

8. The lid of claim 7, wherein the valve body further comprises a valve seat defining a sealable valve opening.

9. The lid of claim 8, wherein the valve further comprises venting means arranged at a side of the sealable valve opening facing the second opening, wherein the venting means is configured to prevent liquid inside the reservoir from entering the flexible tube while permitting air movement from the outside of the reservoir to an interior of the reservoir.

10. The lid according to claim 9, wherein the venting means comprises an elastically deformable membrane.

11. The lid according to claim 10, wherein the venting means further comprises a sealing liquid disposed between the valve seat and the elastically deformable membrane.

12. A lid for a reservoir to be connected to a liquid spraying device, comprising:

a ventilation hole;

a flexible tube; and a valve, wherein a combination of the ventilation hole, the flexible tube, and the valve forms a ventilation system which allows an air movement in a first direction, from the ventilation hole and through the flexible tube and valve, while blocking movement of a liquid in a second direction opposite the first direction, from the valve and through the flexible tube and ventilation hole, and wherein the flexible tube includes a hinge positioned nearby the ventilation hole, and wherein the hinge is configured to permit an orientation of the flexible tube in multiple directions relative to the ventilation hole.

13. A lid for a reservoir to be connected to a liquid spraying device, comprising:

a ventilation hole;

a flexible tube;

a valve; and at least one clamp configured to detachably connect the flexible tube and/or the valve to the lid at a location spaced from the ventilation hole, wherein a combination of the ventilation hole, the flexible tube, and the valve forms a ventilation system which allows an air movement in a first direction, from the ventilation hole and through the flexible tube and valve, while blocking movement of a liquid in a second direction opposite the first direction, from the valve and through the flexible tube and ventilation hole.

* * * * *